United States Patent [19]

Scarfone

[11] 4,333,281

[45] Jun. 8, 1982

[54] BASEMENT WALL DRAINING MOLDING

[75] Inventor: Santo Scarfone, Windsor, Canada

[73] Assignee: Scarfone Construction Limited, Windsor, Canada

[21] Appl. No.: 128,523

[22] Filed: Mar. 10, 1980

[30] Foreign Application Priority Data

Feb. 14, 1980 [CA] Canada ..... 348689

[51] Int. Cl.[3] ..... E04B 1/70; E02D 31/02

[52] U.S. Cl. ..... 52/169.5; 52/302

[58] Field of Search ..... 52/169.5, 302, 58, 61, 52/411, 412, 771

[56] References Cited

U.S. PATENT DOCUMENTS

| | | | |
|---|---|---|---|
| 1,065,507 | 6/1913 | Cook et al. | 52/771 X |
| 1,334,398 | 3/1920 | Plym et al. | 52/302 |
| 2,159,735 | 5/1939 | Gast | 52/302 X |
| 2,703,002 | 3/1955 | Suskind | 52/302 |
| 2,948,993 | 8/1960 | Marchi | 52/169.5 X |
| 3,273,296 | 9/1966 | Soulon | 52/302 X |
| 3,850,193 | 11/1974 | Guzzo | 52/169.5 X |
| 3,852,925 | 12/1974 | Gazzo | 52/169.5 |
| 3,925,952 | 12/1975 | Hagel et al. | 52/235 X |
| 4,185,429 | 1/1980 | Mendola | 52/169.5 X |
| 4,245,443 | 1/1981 | Beechen | 52/169.5 |

*Primary Examiner*—Stephen J. Novosad

*Attorney, Agent, or Firm*—Riches, McKenzie & Herbert

[57] ABSTRACT

A basement wall drain unit for removing moisture from a basement wall formed of concrete blocks resting on a footing adjacent a concrete basement floor, wherein the concrete floor is poured against the drain unit so that a space is formed between the drain unit and an inner surface of the wall and between the drain unit and the footing into which moisture may drain from the interior of the wall through drain passages in the wall and then down beneath the basement floor to a weeping drain.

9 Claims, 6 Drawing Figures

FIG. 3
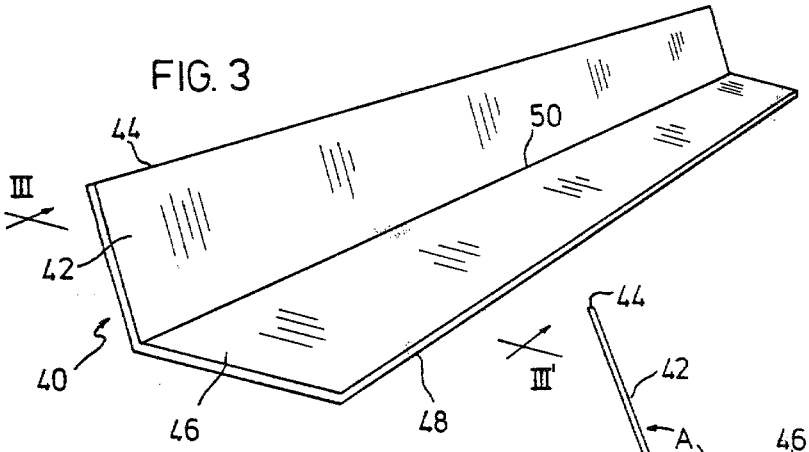
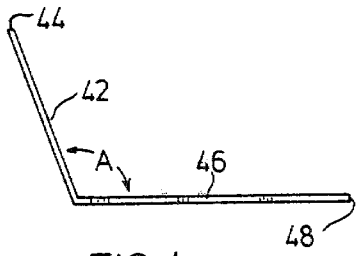
FIG. 4
FIG. 5
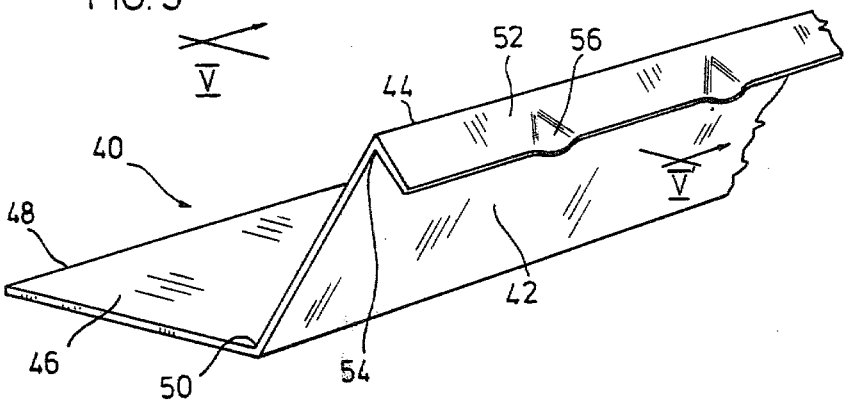
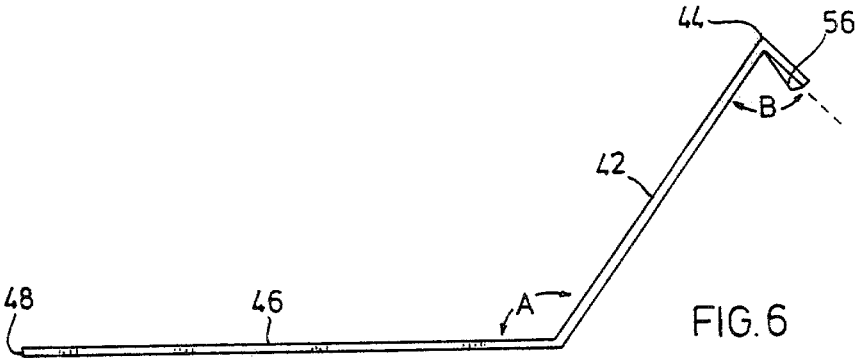
FIG. 6

BASEMENT WALL DRAINING MOLDING

BACKGROUND OF THE INVENTION

This invention relates generally to basement wall drain units, and more particularly to basement wall drain units for removing moisture from the inner surface and interior of basement walls.

Moisture is known to collect in the interior of basement walls and to run down the inner surface of basement walls due to a multitude of causes, including seepage through the walls from the surrounding ground and condensation. The presence of such moisture is disadvantageous, tending to prevent basements from being fully utilized as living, recreational or functional areas.

In the past, many forms of wall drains and wall-and-floor constructions have been suggested. For example, U.S. Pat. No. 2,703,002 issued to P. A. Suskind on Mar. 1, 1955, teaches a structure to be affixed to basement walls above the surface of the floor having a sloped trough adapted to collect water seeping through the walls, which water may then be lead by means of channels to a floor drain. This structure has the disadvantages that the channels must be placed in the floors and connected to the floor drains, the troughs are difficult to mount on the walls to provide a suitable slope, and the structure does not allow for the removal of water from the inner surface or interior of the walls below the trought.

A more recent patent, U.S. Pat. No. 2,948,993 issued to A. P. Marchi on Aug. 16, 1960, discloses a method of forming basement walls and floors in which vertical members are located adjacent the inner surface of the walls to form vertical drain passages. One disadvantage to this patent is the failure to provide any means to prevent, upon pouring of the concrete floor, the concrete from forming a water impermeable junction with the footing thereby preventing water drainage. Another similar disadvantage arises upon pouring of the concrete floor in that the vertical members have a tendency to be lifted by a floatation effect of the dense liquid concrete acting on the vertical members thereby allowing concrete to flow underneath and behind the displaced vertical members and preventing water drainage upon its solidification. A third disadvantage is that the vertical members are not suitable for use in renovating existing wall-and-floor construction where panelling is affixed to the walls. The presence of panelling prevents the location adjacent the inner surface of the walls of vertical members with sufficient height to ensure that concrete will not flow over the upper edges of the vertical members and upon solidification prevent water drainage. The vertical members must be placed adjacent the inner surface of the walls and can not be located adjacent the panelling as the vertical members require the support of the inner surface of the wall below the surface of the floor to retain the concrete.

SUMMARY OF THE INVENTION

Accordingly, it is an object of the present invention to at least partially overcome these disadvantages by providing a novel basement wall drain unit which ensures the formation of a water permeable passageway between the drain unit and both the basement wall and footing to allow moisture to drain through the passageway to a weeping drain.

It is a further object of the present invention to provide a basement wall drain unit which is easily located and retained in position during pouring of the concrete floor.

It is a further object of the present invention to provide a basement drain wall unit which is adapted for use in initial wall-and-floor construction and which is adapted for use in renovation of existing wall-and-floor construction having both panelled and unpanelled walls.

Accordingly, in one of its aspects this invention provides a basement wall drain unit for removing moisture from a wall formed of concrete blocks to have a base, an interior, and an inner surface, the blocks being laid on a footing with a weeping drain extending beneath a concrete basement floor having an upper surface and along a portion of the footing which extends inwardly past the inner surface of the wall, a plurality of horizontally spaced drain passages having been formed to extend from the interior of the wall to the inner surface of the wall near the base of the wall, the drain unit comprising an elongate sheet-like integral body having a substantially uniform cross section to extend adjacent the base of the wall generally above the inner portion of the footing with the concrete basement floor poured against it, the body having a first wing portion spaced from the inner surface of the wall and extending upwardly to an upper edge above the upper surface of the concrete basement floor; and a second wing portion extending inwardly from the first wing portion to an inner edge beyond the inner portion of the footing, spacing being provided between the second wing portion and the inner portion of the footing; whereby a space is formed between the drain unit and the inner surface of the wall and the inner portion of the footing into which moisture may drain from the interior of the wall through the drain passages and then down into an area beneath the basement floor adjacent the weeping drain.

In another of its aspects, this invention provides a basement wall drain unit for removing moisture from a wall formed of concrete blocks to have a base, an interior, and an inner surface. The blocks are laid on a footing with a weeping drain extending beneath a concrete basement floor having an upper surface and along a portion of the footing which extends inwardly past the inner surface of the wall. A plurality of horizontally spaced drain passages are formed to extend from the interior of the wall to the inner surface of the wall near the base of the wall. The drain unit comprises an elongated sheet-like integral body having a substantially uniform cross-section to extend adjacent the base of the wall generally above the inner portion of the footing with the concrete basement floor poured against it. The body has: a first wing portion spaced from the inner surface of the wall and extending upwardly to an upper edge above the upper surface of the concrete basement floor; a second wing portion extending inwardly from the first wing portion to an inner edge beyond the inner portion of the footing with spacing being provided between the second wing portion and the inner portion of the footing: and, a lip portion sloping downward and outwardly from the upper edge of the first wing portion to abut against the inner surface of the wall with the lip portion having spaced indentations therealong to form openings between it and the inner surface of the wall, whereby moisture may drain down from the inner surface of the wall, through the openings into a space formed between the drain unit and the inner portion of the footing and may drain from the interior of the wall through the drain passages into the space and then down into an area beneath the basement floor adjacent the weeping drain.

Many forms of the basement wall drain unit according to the present invention will occur to those skilled in the art. For example, the drain units may be provided with totally or partially flat or cross-sectionally arcuate first wing portions, second wing portions or lip portions. The wing and lip portions may be joined by longitudinally extending fold lines or may merge as adjacent longitudinally extending cross-sectionally arcuate portions. The lip portions may be provided with alternative means to the spaced indentations to allow moisture to drain past the lip portions, as for example, by holes drilled through the lip portion. Further, alternative forms of the drain unit would include drain units provided with corrugated wing and lip portions.

The drain units may be constructed out of many materials or composites of materials known to those skilled in the art. Suitable materials include sheet metals, notably galvanized sheet metal, and plastic sheeting. There is no requirement of water impermeability for suitability of a given material although water impermeability of the lip portion may be advantageous. The drain unit must retain liquid concrete during the pouring of the concrete floor and may provide its own structural support or be supported in full or in part by, as for example, water permeable filler means such as gravel. The drain unit may be spaced from the inner surface of the wall or from the inner portion of the footing by a variety of means including the placement of water-permeable filler such as gravel therebetween and the abutment of the lip portion against the inner surface of the wall.

BRIEF DESCRIPTION OF THE DRAWINGS

Further objects and advantages of the invention will appear from the following description taken together with the accompanying drawings in which:

FIG. 3 is a pictorial view of the first embodiment of the basement wall drain unit.

FIG. 4 is a cross-sectional view of the first embodiment taken through the axis III—III' on FIG. 3.

FIG. 5 is a pictorial view of the second embodiment of the basement wall drain unit.

FIG. 6 is a cross-sectional view of the second embodiment taken through the V—V' axis of FIG. 5.

DESCRIPTION OF THE PREFERRED EMBODIMENTS

Figure 1:
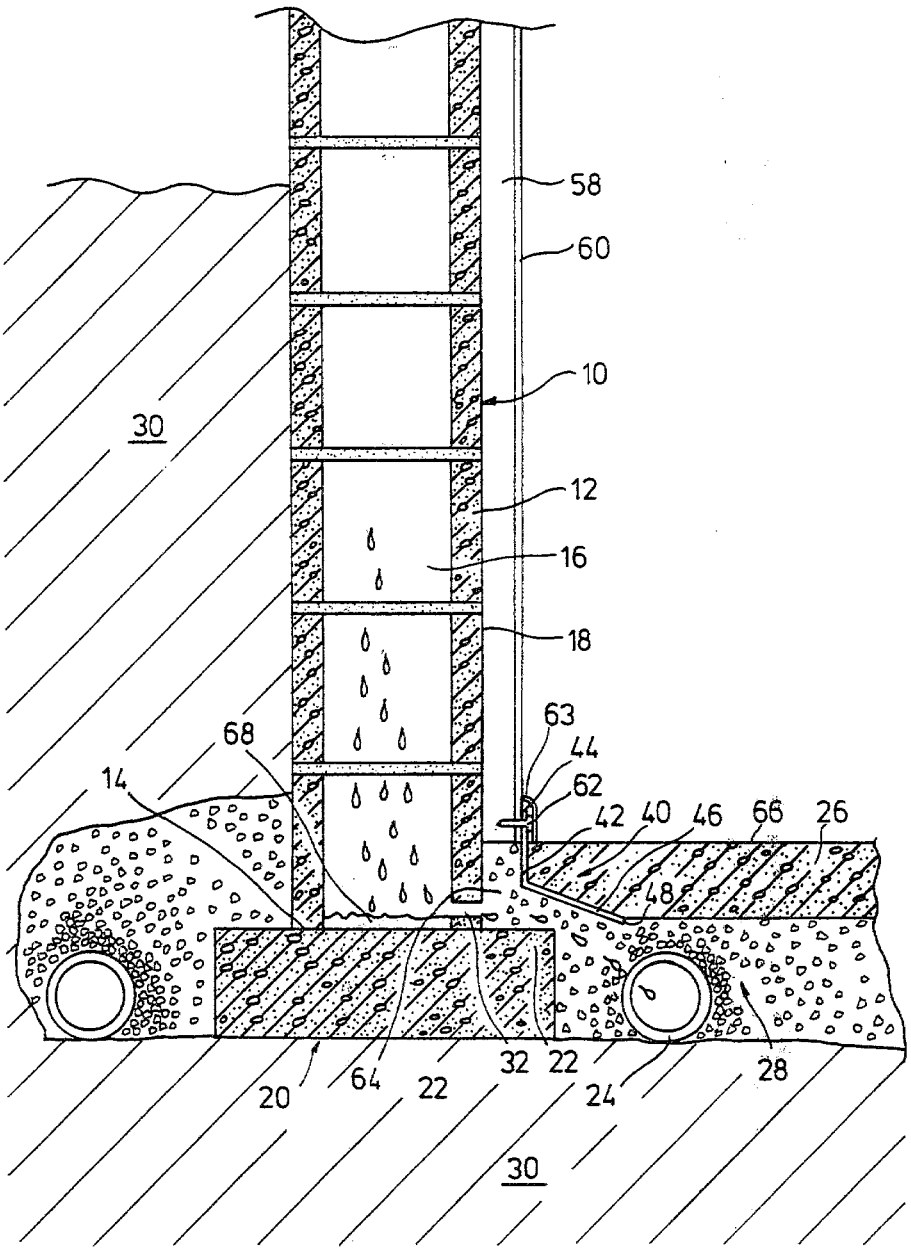
FIG. 1 is a cross-sectional view of a panelled basement wall-and-floor construction fitted with a basement wall drain unit according to a first embodiment of the present invention.
Figure 2:
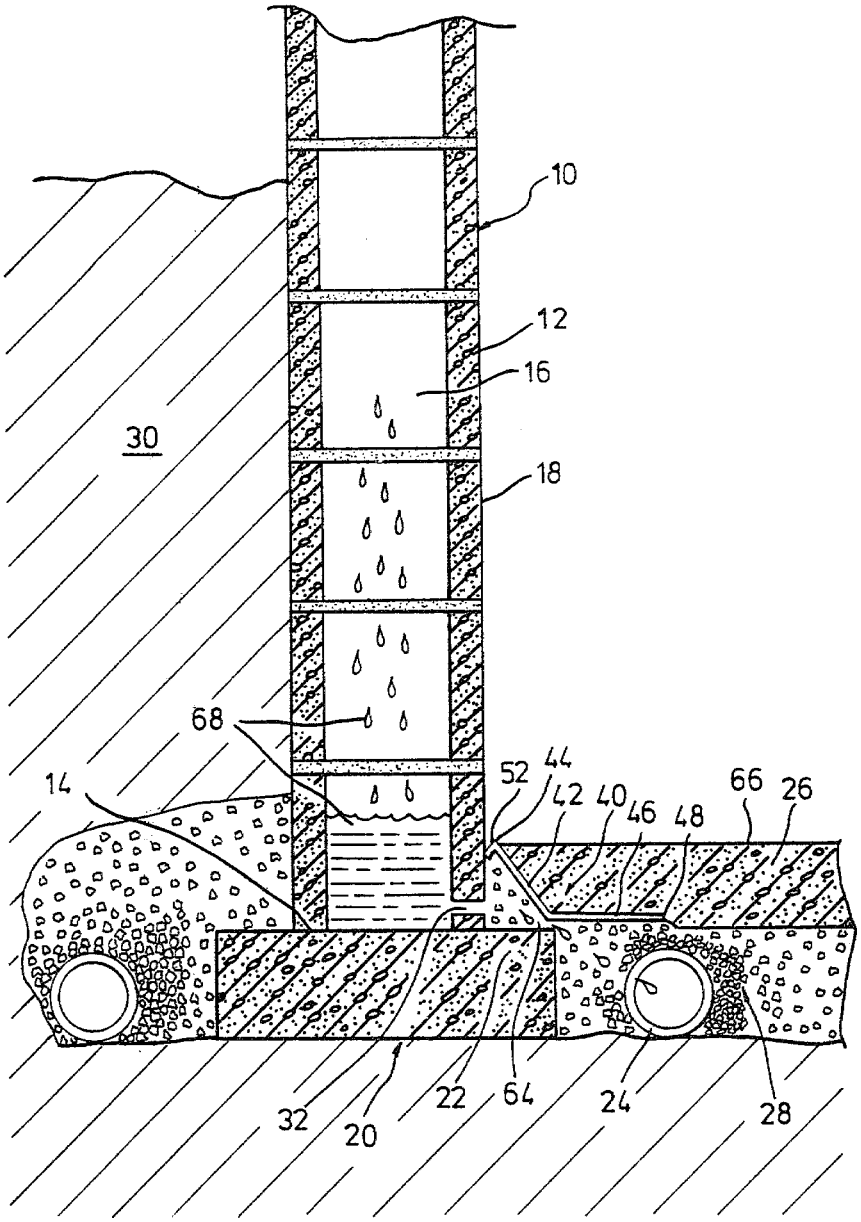
FIG. 2 is a cross-sectional view of an unpanelled basement wall-and-floor construction fitted with a basement wall drain unit according to a second embodiment of the present invention.

Reference is made to FIGS. 1 and 2 which show a basement wall 10 constructed of concrete blocks 12 and having a base 14, an interior 16 and an inner surface 18. The basement wall 10 is laid on a footing 20 which has an inner portion 22 extending inwardly past inner surface 18 of wall 10. A weeping drain 24 extends along the footing 20 in the area beneath a concrete floor 26 containing a water-permeable gravel bed 28. Earth 30 surrounds walls 10 and underlies footing 20 and gravel bed 28.

Drain passages 32 are formed in blocks 12 of wall 10 to extend from the interior 16 of wall 10 to the inner surface 18 of wall 10 near its base 14. Drain passages 32 may be provided by any conventional methods, as for example, by drilling holes in blocks 12. Preferably at least one drain passage 32 should be located in each concrete block 12 along base 14 of wall 10 to run from the interior 16 to the inner surface 18 of wall 10. It is advantageous for drain passages 32 to be located as near as possible to base 14 of wall 10. For example, a favourable location of drain passages 32 is approximately two to three centimeters above base 14 of wall 10, to allow clearance above concrete or mortar which may be affixed to footing 20 within the interior 16 of block 12. Additional drain passages may also be provided in blocks 12 above base 14 of wall 10.

Reference is now made to FIGS. 3 to 6 showing two embodiments of the basement wall drain unit. Each drain unit is designated generally as 40 has a flat first wing portion 42 ending at an upper edge 44 and a flat second wing portion 46 ending at an inner edge 48. A first longitudinally extending fold line 50 defines a first included angle A between first wing portion 42 and second wing portion 46. As shown in FIG. 5, the second embodiment further comprises a lip portion 52 sloping downwardly and outwardly from upper edge 44 of first wing portion 42. A second longitudinally extending fold line 54 defines a second included angle B between lip portion 52 and first wing portion 42. Indentations 56 are spaced along lip portion 52.

Experience has shown that it is advantageous that the first included angle A be between about 90° to about 150° with a preferred first included angle A for the first embodiment of about 120° and a preferred first included angle A for the second embodiment of about 125°. The range of the second included angle B is from greater than about A-90° to less than about A wherein A is the first included angle. A favorable second included angle B for the second embodiment is about 75°.

FIG. 1 shows a basement wall drain unit of the first embodiment located adjacent a panelled wall-and-floor construction having strapping 58 secured to wall 10 and panelling 60 secured to strapping 58, by suitable means not shown. The drain unit 40 abuts panelling 60 and is spaced from inner surface 18 of wall 10 by strapping 58 and panelling 60. A fastening device 62, as for example, a conventional nail, may secure the drain unit 40 to the panelling 60. Suitable cover means 63, such as a conventional baseboard, may hide the drain unit 40 and fastening device 62 from view.

FIG. 2 shows a basement wall drain unit of the second embodiment located adjacent an unpanelled wall-and-floor construction. Lip portion 52 abuts inner surface 18 of wall 10 spacing inner surface 18 of wall 10 from first wing portion 42. Indentations 56 on lip portion 52 provide for openings between lip portion 52 and the inner surface 18 of wall 10, through which moisture which flows down the inner surface 18 of wall 10 may drain from above the lip portion 52 to the space below the lip portion 52 between the inner surface 18 of wall 10 and the drain unit 40.

As seen in both FIGS. 1 and 2, the drain unit 40 is located above the inner portion 22 of footing 20 with water permeable filler, such as gravel, 64 to provide spacing between inner portion 22 of footing 20 and second wing portion 46. The water impermeable filler 64 may also partially or completely occupy the space between the inner surface 18 of wall 10 and the first wing portion 42 to aid in the location and structural support of drain unit 40.

The first wing portion 42 extends upwardly to locate the upper edge 44 above the upper surface 66 of concrete floor 26 to ensure that during pouring of concrete floor 26 so that concrete may not flow over the upper edge 44 and block the space between inner surface 18 of wall 10 and drain unit 40. The second wing portion 46 extends inwardly to locate the inner edge 48 inside of the inner portion 22 of footing 20 to ensure that during pouring of concrete floor 26, concrete may not block the space between footing 20 and drain unit 40.

The operation of the first embodiment of the basement wall drain unit is now described with reference to FIG. 1. The operation of the second embodiment is analogous. As shown, moisture 68 which has accumulated in the interior 16 of wall 10 will flow through drain passages 32 from the interior 16 into the space between the drain unit 40 and wall 10 and footing 20. Moisture on the inner surface 18 of wall 10 will flow down inner surface 18 into the space between drain unit 40 and wall 10 and footing 20. The moisture will then drain via the water permeable passageway formed by the space between the drain unit 40 and the wall 10 and the footing 20 to gravel bed 28 located in the area beneath concrete floor 26 adjacent weeping drain 24.

The basement wall drain units according to this invention are suitable for use in the initial construction of basements as well as in the renovation of existing basement wall-and-floor construction. In renovation of basement walls with panelling the drain unit of the first embodiment is preferable while, in renovation of basement walls without panelling and in new construction, the second embodiment is preferable. When pouring concrete floors generally, the second wing portion 46 facilitates the pouring operation in that the weight of the concrete on second wing portion 46 immobilizes drain unit 40 on top of gravel 64 thereby preventing the displacement of drain unit 40 and precluding concrete from flowing into the space between drain unit 40 and wall 10 and footing 20 which cement upon solidification may prevent moisture drainage.

Although the description of the invention has been given with respect to particular embodiments, it is not to be construed in a limiting sense. Many variations and modifications will occur to those skilled in the art. For a definition of the invention reference is made to the annexed claims.

What I claim is:

1. A basement wall drain unit for removing moisture from a wall formed of concrete blocks to have a base, an interior, and an inner surface, the blocks being laid on a footing with a weeping drain extending beneath a concrete basement floor having an upper surface and along a portion of the footing which extends inwardly past the inner surface of the wall, a plurality of horizontally spaced drain passages having been formed to extend from the interior of the wall to the inner surface of the wall near the base of the wall, the drain unit comprising an elongated sheet-like integral body having a substantially uniform cross section to extend adjacent the base of the wall generally above the inner portion of the footing with the concrete basement floor poured against it, the body having:

(a) a first wing portion spaced from the inner surface of the wall and extending upwardly to an upper edge above the upper surface of the concrete basement floor; and (b) a second wing portion extending inwardly from the first wing portion to an inner edge beyond the inner portion of the footing, spacing being provided between the second wing portion and the inner portion of the footing;

whereby a space is formed between the drain unit and the inner surface of the wall and the inner portion of the footing into which moisture may drain from the interior of the wall through the drain passages and then down into an area beneath the basement floor adjacent the weeping drain, said body further having:

(c) a lip portion sloping downwardly and outwardly from the upper edge of the first wing portion to abut against the inner surface of the wall, the lip portion having spaced indentations therealong to form openings between it and the inner surface of the wall, whereby moisture may drain down from the inner surface of the wall, through the openings into said space between the drain unit and the inner surface of the wall and the inner portion of the footing and then down into the area beneath the basement floor adjacent the weeping drain.

2. A basement wall drain unit as claimed in claim 1 wherein said body is formed from sheet metal.

3. A basement wall drain unit as claimed in claim 1 wherein the first and second wing portions are flat and are joined along a first longitudinally extending fold line to define a first included angle of from about 90° to about 150° and wherein the lip portion is joined to the first wing portion along a second longitudinally extending fold line to define a second included angle of from greater than about X°-90° to less than about X° wherein X° is the first included angle.

4. A basement wall drain unit as claimed in claim 1 or 3 wherein the lip portion is water impermeable.

5. A basement wall drain unit as claimed in claim 1 wherein said body is water impermeable.

6. A basement wall drain unit as claimed in claim 3 wherein said first included angle is from about 120° to about 130° and said second included angle is from about 70° to about 80°.

7. A basement wall drain unit for removing moisture from a wall formed of concrete blocks to have a base, an interior, and an inner surface, the blocks being laid on a footing with a weeping drain extending beneath a concrete basement floor having an upper surface and along a portion of the footing which extends inwardly past the inner surface of the wall, a plurality of horizontally spaced drain passages having been formed to extend from the interior of the wall to the inner surface of the wall near the base of the wall, the drain unit comprising an elongated sheet-like integral body having a substantially uniform cross section to extend adjacent the base of the wall generally above the inner portion of the footing with the concrete basement floor poured against it, the body having:

(a) a first wing portion spaced from the inner surface of the wall and extending upwardly to an upper edge above the upper surface of the concrete basement floor; and (b) a second wing portion extending inwardly from the first wing portion to an inner edge beyond the inner portion of the footing, spacing being provided between the second wing portion and the inner portion of the footing;

whereby a space is formed between the drain unit and the inner surface of the wall and the inner portion of the footing into which moisture may drain from the interior of the wall through the drain passages and then down into an area beneath the basement floor adjacent the weeping drain, said body further having:

(c) a water impermeable lip portion sloping downwardly and outwardly from the upper edge of the first wing portion to abut against the inner surface of the wall, the lip portion having spaced openings therealong through the lip portion whereby moisture may drain down from the inner surface of the wall through the lip portion via the openings into said space between the drain unit and inner surface of the wall and the inner portion of the footing and then down into the area beneath the basement floor adjacent the weeping drain.

8. A basement wall drain unit for removing moisture from a wall formed of concrete blocks to have a base, an interior, and an inner surface, the blocks being laid on a footing with a weeping drain extending beneath a concrete basement floor having an upper surface and along a portion of the footing which extends inwardly past the inner surface of the wall, the drain unit comprising an elongated sheet-like integral body having a substantially uniform cross section to extend adjacent the base of the wall generally above the inner portion of the footing with the concrete basement floor poured against it, the body having:

(a) a first wing portion spaced from the inner surface of the wall and extending upwardly to an upper edge above the upper surface of the concrete basement floor; and (b) a second wing portion extending inwardly from the first wing portion to an inner edge beyond the inner portion of the footing, spacing being provided between the second wing portion and the inner portion of the footing;

whereby a space is formed between the drain unit and the inner surface of the wall and the inner portion of the footing, said body further having:

(c) a lip portion sloping downwardly and outwardly from the upper edge of the first wing portion to abut against the inner surface of the wall, the lip portion having spaced indentations therealong to form openings between it and the inner surface of the wall, whereby moisture may drain down from the inner surface of the wall, through the openings into said space between the drain unit and the inner surface of the wall and the inner portion of the footing and then down into the area beneath the basement floor adjacent the weeping drain.

9. A basement wall drain unit for removing moisture from a wall formed of concrete blocks to have a base, an interior, and an inner surface, the blocks being laid on a footing with a weeping drain extending beneath a concrete basement floor having an upper surface and along a portion of the footing which extends inwardly past the inner surface of the wall, the drain unit comprising an elongated sheet-like integral body having a substantially uniform cross section to extend adjacent the base of the wall generally above the inner portion of the footing with the concrete basement floor poured against it, the body having:

(a) a first wing portion spaced from the inner surface of the wall and extending upwardly to an upper edge above the upper surface of the concrete basement floor; and (b) a second wing portion extending inwardly from the first wing portion to an inner edge beyond the inner portion of the footing, spacing being provided between the second wing portion and the inner portion of the footing;

whereby a space is formed between the drain unit and the inner surface of the wall and the inner portion of the footing, said body further having:

(c) a water impermeable lip portion sloping downwardly and outwardly from the upper edge of the first wing portion to abut against the inner surface of the wall, the lip portion having spaced openings therealong through the lip portion whereby moisture may drain down from the inner surface of the wall through the lip portion via the openings into said space between the drain unit and the inner surface of the wall and the inner portion of the footing and then down into the area beneath the basement floor adjacent the weeping drain.

* * * * *